US006880552B1

(12) United States Patent
Veret

(10) Patent No.: US 6,880,552 B1
(45) Date of Patent: Apr. 19, 2005

(54) VARIABLE WOOD BURNING TOOL

(76) Inventor: Victoria Veret, 2255 Benson Ave., Apt 5H, Brooklyn, NY (US) 11214

( * ) Notice: Subject to any disclaimer, the term of this patent is extended or adjusted under 35 U.S.C. 154(b) by 0 days.

(21) Appl. No.: 10/861,539

(22) Filed: Jun. 4, 2004

(51) Int. Cl.[7] ..... B44B 7/02
(52) U.S. Cl. ..... 126/405
(58) Field of Search ..... 126/401, 402, 126/405, 411, 413; 219/233, 229; 30/140; 401/1

(56) References Cited

U.S. PATENT DOCUMENTS

| | | | | | |
|---|---|---|---|---|---|
| 695,884 | A | * | 3/1902 | Mueller | 126/405 |
| 754,129 | A | * | 3/1904 | Dietz | 126/405 |
| 792,206 | A | * | 6/1905 | Figg | 126/405 |
| 1,053,265 | A | * | 2/1913 | Baer et al. | 126/405 |
| 2,494,840 | A | | 1/1950 | Stephenson | 219/23 |
| 2,734,986 | A | | 2/1956 | Gameros | 219/29 |
| 2,761,946 | A | * | 9/1956 | Bronstein | 219/239 |
| 2,790,059 | A | | 4/1957 | Burnett | 219/26 |
| RE28,752 | E | * | 3/1976 | Balamuth et al. | 318/116 |
| 3,985,137 | A | * | 10/1976 | Donohue | 606/29 |
| 5,073,696 | A | * | 12/1991 | Patillo et al. | 219/233 |
| 5,921,231 | A | * | 7/1999 | Butler | 126/414 |
| 6,294,759 | B1 | * | 9/2001 | Dunn, Jr. | 219/231 |

* cited by examiner

*Primary Examiner*—Stephen Gravini
(74) *Attorney, Agent, or Firm*—Goldstein Law Offices, P.C.

(57) ABSTRACT

A variable wood burning tool for burning woods at varying temperatures and providing alternate uses essentially comprised of a container and a lid hingedly secured thereto. An interior surface of the lid has a heat resistant tray disposed therein. A heating element is disposed within the container. A burning wand is operatively coupled with the heating element. A plurality of tips are provided that are each adapted for removably coupling with the burning wand.

8 Claims, 2 Drawing Sheets

VARIABLE WOOD BURNING TOOL

BACKGROUND OF THE INVENTION

The invention relates to a variable wood burning tool for burning wood at varying temperatures. More particularly, the invention relates to a wood burning tool having flexibility in use so as to greatly facilitate the creative process.

While wood burning can be quite entertaining for those who pursue this challenging craft, there are some major drawbacks associated with this activity. The traditional wood burning tool has remained pretty much unchanged in design and function, offering only one temperature setting and only one burning tip. Different types of wood burn at different rates, so having a burning tool with only one heat setting means the wood crafter has to allow for these differences. With a standard wood burning tool, one must painstakingly work around the tool's lack of versatility in order to achieve the desired results.

U.S. Pat. No. 2,734,989 to Gameros discloses a pyrograph. U.S. Pat. No. 2,790,056 to Burnett discloses a resistance soldering device and method. U.S. Pat. No. 2,494,840 to Stephenson discloses an automatic soldering iron control.

While these units may be suitable for the particular purpose employed, or for general use, they would not be as ´´asuitable for the purposes of the present invention as disclosed hereafter.

SUMMARY OF THE INVENTION

It is an object of the invention to produce a variable wood burning tool that has great flexibility in use. Accordingly, the wood burning tool is user settable to provide for burning wood at varying temperatures.

It is a further object of the present invention to produce a variable wood burning tool that may be set down between uses and for safe cooling after use. Accordingly, a heat resistant tray allows the wand to be safely set down, even when heated to operating temperature.

It is another further object of the present invention to provide a variable wood burning tool that accurately indicates the wand temperature. Accordingly, the tool has a digital display for indicating the temperature of the heating element.

The present invention is a variable wood burning tool for burning woods at varying temperatures and providing alternate uses essentially comprised of a container and a lid hingedly secured thereto. An interior surface of the lid has a heat resistant tray disposed therein. A heating element is disposed within the container. A burning wand is operatively coupled with the heating element. A plurality of tips are provided that are each adapted for removably coupling with the burning wand.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
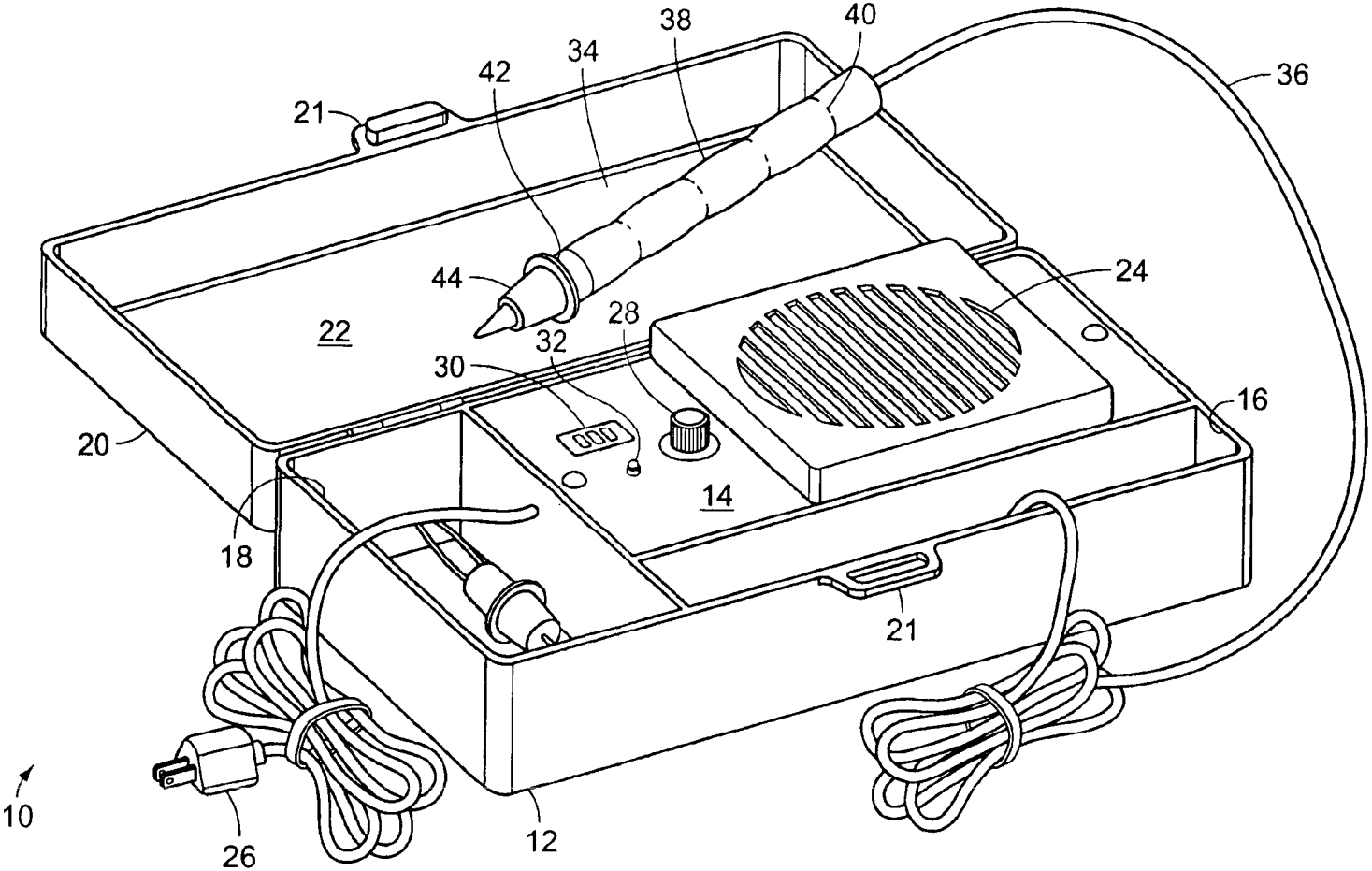
FIG. 1 is a perspective view of the present invention in an open orientation.
Figure 2:
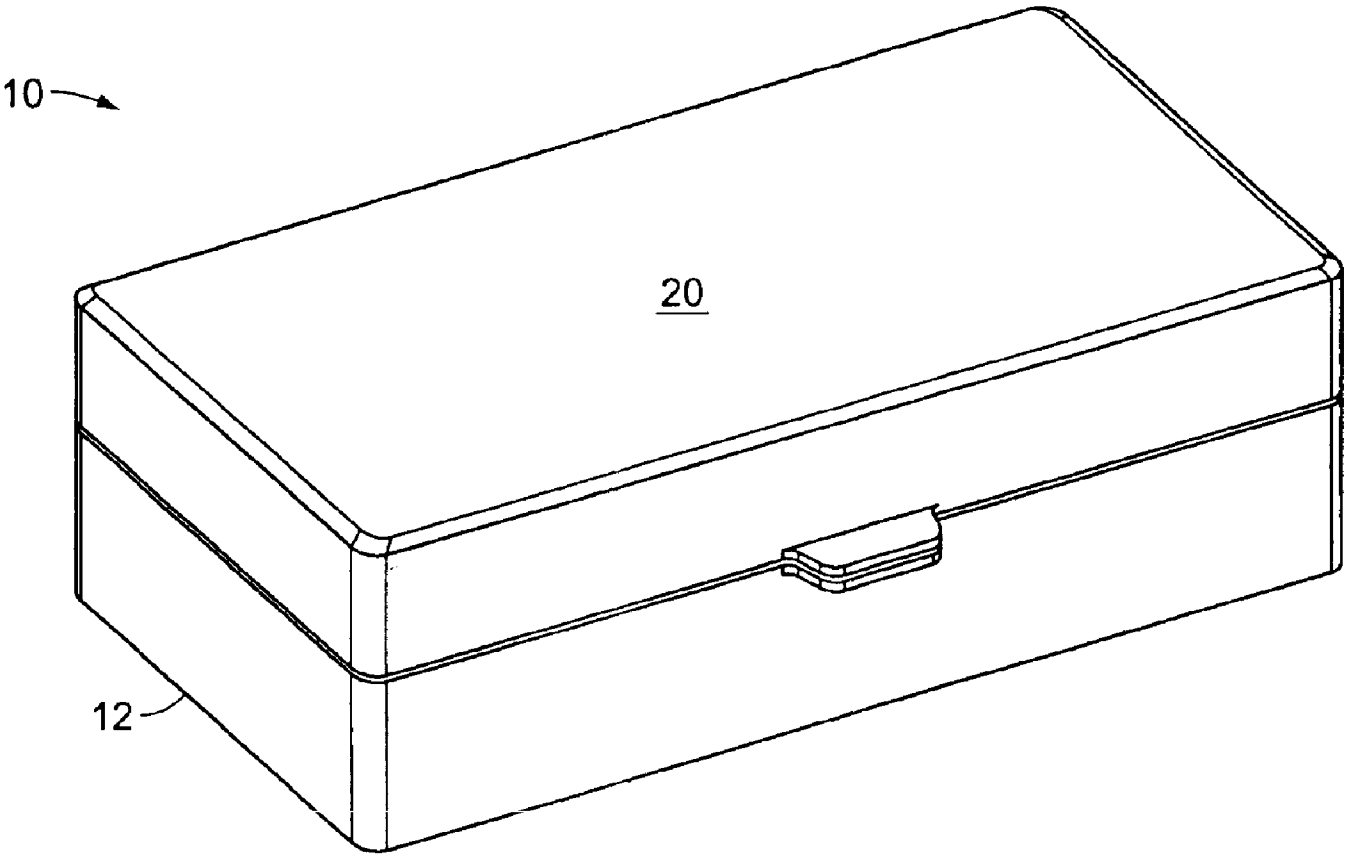
FIG. 2 is a perspective view of the present invention in a closed orientation.

FIGS. 1 and 2 illustrate a variable wood burning tool 10 for burning wood at varying temperatures and providing alternate uses.

The wood burning tool 10 includes a container 12 having a generally rectangular configuration. The container 12 has a closed compartment 14, a first open compartment 16, and a second open compartment 18. The wood burning tool has a lid 20 hingedly secured to the container 12, for selectively covering the container and the first and second open compartments 16 and 18. The lid has a top interior surface 20T, and has a heat resistant tray 22 at said top interior surface 20T. The heat resistant tray 22 is made of a insulative material that can endure prolonged exposure and direct contact with a hot burning tool, as will be described hereinafter. The container 12 and lid 20 are each provided with mating latches 21 to facilitate securing the lid 20 with respect to the container 12 in a closed position.

A heating element is disposed within the closed compartment 14 of the container 12. The heating element includes a heat exhaust vent 24 extending outwardly of the closed compartment 14 to vent excess heat. The heating element includes an electrical plug 26 for coupling with an electrical outlet. Power to the heating element is varied by a temperature control knob 28 disposed on the closed compartment 14. The heating element includes a digital temperature indicator 30 disposed on the closed compartment 14. The heating element includes a time activated internal shut-off switch that will power down the heating element after a predetermined time period has elapsed. In use, the vent 24 will provide the heating element the proper ventilation. The temperature control knob 28 will allow the temperature of the heating element to be adjusted to any desired level, that the user deems most suitable when working with specific types of wood and other material. The temperature indicator 30 will allow the user to know the temperature of the heating element prior to, and during use. The shut down switch will automatically deactivate the heating element after a period of non-use. Additionally, the heating element includes an activation light 32 that will be illuminated when the heating element is powered.

A burning wand 34 is provided that is operatively coupled with the heating element through a cord 36. The burning wand 34 includes a handle 38. The cord 36 extends outwardly from the heating element within the closed compartment, and communicates heat through the handle 38 to a tip 44. The handle 38 has a series of gripping indentations 40 formed thereon. The handle 38 has an open upper end 42. The indentations 40 assist the user in gripping and handling the burning wand 34. When the burning wand 34 is not being used, it can rest on the heat resistant tray 22. Note FIG. 1. The cord 36 can be positioned within the first open compartment 16 when not in use.

Several tips 44 are provided with the tool 10. Each tip is adapted for removably coupling with the open upper end 42 of the handle 38 of the burning wand 34. The plurality of tips 44 include, but are not limited to, wood burning tips, soldering tips, bag sealing tips, cutting and fusing tips, and a plastic sealer tip. The tips 44 can be stored in the second open compartment 18 when not in use.

In conclusion, herein is presented a variable wood burning tool for burning woods at varying temperatures and providing alternate uses. The invention is illustrated by example in the drawing figures, and throughout the written description. It should be understood that numerous variations are possible, while adhering to the inventive concept. Such variations are contemplated as being a part of the present invention.

What is claimed is:

1. A variable wood burning tool for burning wood at varying temperatures, comprising:

a container having a generally rectangular configuration, the container having a closed compartment, a first open compartment, and a second open compartment, the container having a lid hingedly secured thereto for selectively covering the first open compartment and second open compartment, the lid having a top interior surface and a heat resistant tray disposed within the lid at said top interior surface;

a heating element disposed within the closed compartment of the container, the heating element including a heat exhaust vent extending outwardly of the closed compartment, the heating element including an electrical plug for coupling with an electrical outlet, the heating element including a temperature control knob disposed on the closed compartment, the heating element including a temperature indicator disposed on the closed compartment, the heating element including a time activated internal shut down switch;

a burning wand operatively coupled with the heating element, the burning wand including a cord a tip, and a handle, the cord extending outwardly from the closed compartment, through the handle, and to the tip, the cord communicating heat from the heating element to the tip, the handle having a series of gripping indentations formed thereon, the handle having an open upper end.

2. A variable wood burning tool for burning wood at varying temperatures and providing alternate uses, comprising:

a container having a first interior compartment and second interior compartment;

a lid hingedly secured to the container for selectively covering the first and second interior compartments, the lid having a top interior surface and a heat resistant tray disposed within the lid at the top interior surface;

a heating element disposed within the container;

a burning wand operatively coupled with the heating element; and a plurality of tips each being adapted for removably coupling with the burning wand, including a wood burning tip, a bag sealing tip, a soldering tip, and a cutting tip, the tips selectively stored within one of the open compartments of the container.

3. The variable wood burning tool as set forth in claim 2, wherein the heating element includes a heat exhaust vent extending outwardly of the container.

4. The variable wood burning tool as set forth in claim 2, wherein the heating element includes an electrical plug for coupling with an electrical outlet.

5. The variable wood burning tool as set forth in claim 2, wherein the heating element includes a temperature control knob disposed on the container.

6. The variable wood burning tool as set forth in claim 2, wherein the heating element includes a digital temperature indicator disposed on the container.

7. The variable wood burning tool as set forth in claim 2, wherein the heating element includes a time activated internal shut-off switch.

8. The variable wood burning tool as set forth in claim 2, wherein the burning wand includes a cord and a handle, the cord extending outwardly from the heating element, the handle having a series of gripping indentations formed thereon.

* * * * *